US008445822B2

(12) United States Patent
Sunne

(10) Patent No.: US 8,445,822 B2
(45) Date of Patent: May 21, 2013

(54) ONE-PIECE NANO/NANO CLASS NANOCOMPOSITE OPTICAL CERAMIC (NNOC) EXTENDED DOME HAVING SEAMLESS NON-COMPLEMENTARY GEOMETRIES FOR ELECTRO-OPTIC SENSORS

(75) Inventor: Wayne L. Sunne, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 385 days.

(21) Appl. No.: 12/821,876

(22) Filed: Jun. 23, 2010

(65) Prior Publication Data

US 2011/0315807 A1 Dec. 29, 2011

(51) Int. Cl.

| | |
|---|---|
| ***F41G 7/22*** | (2006.01) |
| ***H01Q 1/42*** | (2006.01) |
| *F41G 7/00* | (2006.01) |
| *H01Q 1/00* | (2006.01) |

(52) U.S. Cl.

USPC ..... 244/3.16; 244/3.1; 244/3.15; 244/3.19; 343/872

(58) Field of Classification Search ..... 244/1 R, 244/3.1, 3.15–3.19, 117 R, 123.1; 343/872, 343/873; 977/700, 832, 834, 932; 252/301.4 R; 501/53–69, 73–78, 94–96.1, 96.3–99, 102–108, 501/121–123, 125–128, 134–140, 151–154; 342/61, 342/62

See application file for complete search history.

(56) References Cited

U.S. PATENT DOCUMENTS

| | | | | |
|---|---|---|---|---|
| 3,898,051 | A | 8/1975 | Schmid | |
| 4,291,848 | A | 9/1981 | Clark | |
| 4,304,603 | A * | 12/1981 | Grossman et al. | 501/136 |
| 4,575,493 | A * | 3/1986 | Rauch, Sr. | 501/73 |
| 4,654,315 | A * | 3/1987 | Hsieh | 501/97.2 |
| 4,930,731 | A * | 6/1990 | Roy et al. | 244/3.16 |
| 5,124,285 | A * | 6/1992 | Dislich | 501/99 |
| 5,358,912 | A * | 10/1994 | Freitag et al. | 501/97.2 |
| 5,573,986 | A * | 11/1996 | Talmy et al. | 501/95.3 |
| 5,677,252 | A * | 10/1997 | Gilde et al. | 501/96.5 |
| 5,775,643 | A * | 7/1998 | McMaster et al. | 244/1 R |
| 6,341,747 | B1 * | 1/2002 | Schmidt et al. | 244/123.1 |
| 6,967,179 | B2 * | 11/2005 | Miele et al. | 501/95.1 |
| 7,335,865 | B2 | 2/2008 | Tibi | |
| 7,688,278 | B2 * | 3/2010 | Frenkel | 343/872 |
| 8,236,200 | B2 * | 8/2012 | Sweeney et al. | 252/301.4 R |
| 2009/0167628 | A1 * | 7/2009 | Frenkel | 343/872 |
| 2009/0283720 | A1 | 11/2009 | Sweeney | |

OTHER PUBLICATIONS

Todd Stefanik et al "Nanocomposite Optical Ceramics for Infrared Windows and Domes" Proc. of SPIE vol. 6545 (2007).

* cited by examiner

*Primary Examiner* — Bernarr Gregory
(74) *Attorney, Agent, or Firm* — Eric A. Gifford

(57) ABSTRACT

A one-piece extended dome having a spanning angle greater than 180 degrees. The dome is integrally formed of a Nano/Nano class Nanocomposite Optical Ceramic (NNOC) material. The extended dome comprises seamless first and second non-complementary geometric shapes, such as a first spherical geometry and a second conical or ogive geometry. The Nano/Nano class NNOC material comprises two or more different chemical phases (nanograins) dispersed in one another, each type having a sub-micron grain dimension in at least the direction of light transmission. The material is a true NNOC material in that all of the constituent elements have sub-micron grain dimensions, there is no host matrix.

19 Claims, 10 Drawing Sheets

ONE-PIECE NANO/NANO CLASS NANOCOMPOSITE OPTICAL CERAMIC (NNOC) EXTENDED DOME HAVING SEAMLESS NON-COMPLEMENTARY GEOMETRIES FOR ELECTRO-OPTIC SENSORS

BACKGROUND OF THE INVENTION

1. Field of the Invention

This invention relates to a transparent dome for electro-optic sensors such as found on airborne platforms, such as a missile or airplane. More particularly, the present invention relates to a one piece extended dome having a spanning angle greater than 180 degrees that is integrally formed of a Nano/Nano class of Nanocomposite Optical Ceramic (NNOC) material.

2. Description of the Related Art

Airborne platforms that carry electro-optical (EO) sensors for such tasks as target acquisition, identification, guidance, etc are generally provided with a transparent dome to protect the optical system. Guided projectiles, such as missiles, rockets and shells, are generally provided with a transparent dome at their front. Behind this dome, and within the body of the projectile, an EO seeker is provided for capturing electromagnetic radiation (EMR) from the target, and conveying target information (e.g. bearing or images) to a guidance system, which in turn guides the projectile to an object or point within the captured images. Aircraft such as planes or helicopters may be provided with a directed infrared countermeasures (DIRCM) system to jam a missile seeker. This system may be mounted on the belly, tail section or elsewhere on the aircraft behind a protective transparent dome.

The dome is generally made of a transparent material that can sustain the aerodynamic and thermal stresses that may be applied on it during the missile or aircraft flight. In many conventional applications the dome is made of Sapphire. Other materials such as silica, aluminum oxynitride (ALON) and nanocomposites have found limited application. US Patent Pub. 2009/0283720 discloses the use of a nanocomposite optical ceramic material to form the window for an ogive-shaped nose cone. As shown in FIG. 2 of 2009/0283720, the nanocomposite material comprises particles of a nano-dispersoid incorporated into the grains of a host matrix material of the type listed in Table 1. As shown the fused polycrystalline grains of the matrix material are not nano-sized. The incorporation of the nano-dispersoid particles into the matrix serves to strengthen the host matrix material. The host matrix material determines the dome's optical properties. The nano-dispersoids are kept small to avoid scattering the IR light and affecting the optical properties.

The size of the field of regard (FOR) that can be obtained by the EO seeker depends on the spanning angle of the dome used. The term "spanning angle" when used herein refers to the actual angular portion that the dome spans without vignetting with respect to a full sphere whose spanning angle is 360°. The angle measured from the longitudinal axis through the center of the dome to the edge of the FOR is one-half the spanning angle and is referred to as the "look angle." Conventional missile domes are made of at most approximately half a sphere size. Therefore, when a conventional optical seeker is provided at the center of dome, and if it is mounted on one, two, or more axes gimbals, this optical sensing unit of the prior art can theoretically view a field of regard of at most 180 degrees. Although it is known that the size of the field of regard depends on the spanning angle of the dome, domes spanning more than half a sphere (180°) are generally not in use. This is so, mainly due to technological obstacles in producing Sapphire and other materials domes with large spanning angles and with the required strength, optical and thermal characteristics. More particularly, production of a Sapphire dome having a spanning angle substantially larger than 180° if at all possible, is a very expensive and complicated task.

As said, the maximal active field of operation of a guided projectile is limited to within the field of regard. In order to increase the field of operation of a guided projectile, it is therefore necessary to increase its field of regard, which in turn depends on the spanning angle of the dome. Manufacturing techniques have been developed to produce domes in which the FOR is greater than 180 degrees. These techniques separately fabricate two pieces, typically a spherical portion similar to a conventional dome and an extended portion, and attach the two pieces. The attachment process creates an optical interface along the line of attachment, which has the deleterious effect of producing a discontinuity as the EO seeker scans the FOR. Such a discontinuity poses a risk the seeker may lose track on the target. As a consequence, such extended domes are generally not in use.

U.S. Pat. No. 4,291,848 entitled "Missile Seeker Optical System" discloses a sphero-conical dome 12 of silica glass that provides off-boresight viewing angles up to 135 degrees. A conical portion 26 is attached to a spherical portion 28 to extend the field of regard. Both inner and outer cone surfaces are tangent to the spherical surfaces of the portion 28 at the point of attachment (col 2, lines 28-30). Corrector lenses are positioned so that the combined conical dome and corrector lens have the same optical power as the spherical portion of the dome, so focus is maintained.

U.S. Pat. No. 7,335,865 entitled "Dome" discloses a spherical dome having a spanning angle larger than 180 degrees. The entire extended dome is spherical obviating the need for corrector lens. The dome is manufactured by growing from single crystals of a ceramic material a first dome portion, which is a portion of a sphere, and a second dome portion, which is a complementary sphere-portion for the first dome portion. The complementary dome portion is attached to the first dome portion thereby forming a front dome having a spanning angle larger than 180 degrees.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides an extended dome having a spanning angle greater than 180 degrees for EO sensors without the optical interface and discontinuity created along the line of attachment of first and second dome portions.

This is accomplished with a one-piece extended dome integrally formed of a Nano/Nano class Nanocomposite Optical Ceramic (NNOC) material. The extended dome comprises seamless first and second non-complementary geometric shapes, such as a first spherical geometry and a second conical or ogive geometry. The Nano/Nano class NNOC material comprises two or more different chemical phases (nanograins) dispersed in one another, each phase having a sub-micron grain dimension in at least the direction approximately perpendicular to the direction of propagation of the transmitted light. The material is a true NNOC material in that all of the constituent elements have sub-micron grain dimensions; there is no host matrix. Furthermore, all of the nanograins have a sub-micron grain dimension in the direction approximately perpendicular to the direction of propagation of the transmitted light and preferably all directions that is less than approximately one-tenth and suitably less than one-twentieth of the wavelength of transmitted light. The different nanograins form material barriers to grain growth of the other thus strengthening the NNOC material. Because both phases of the NNOC material are nanoscale, strength reducing processing flaws commonly associated with a larger-grained matrix phase are absent. The mixture of the phases in the NNOC material determines the dome's optical properties.

These and other features and advantages of the invention will be apparent to those skilled in the art from the following detailed description of preferred embodiments, taken together with the accompanying drawings, in which:

DETAILED DESCRIPTION OF THE INVENTION

The present invention provides a cost-effective extended dome having a spanning angle greater than 180 degrees without the optical interface and discontinuity created along the line of attachment of the first and second non-complementary geometries. The extended dome is an enabling technology that addresses a long felt need in the industry to provide a cost-effective design for a seamless extended dome having a spanning angle greater than 180 degrees. The extended dome may be used, for example, with guided projectiles or DIRCM systems.

Figure 1A:
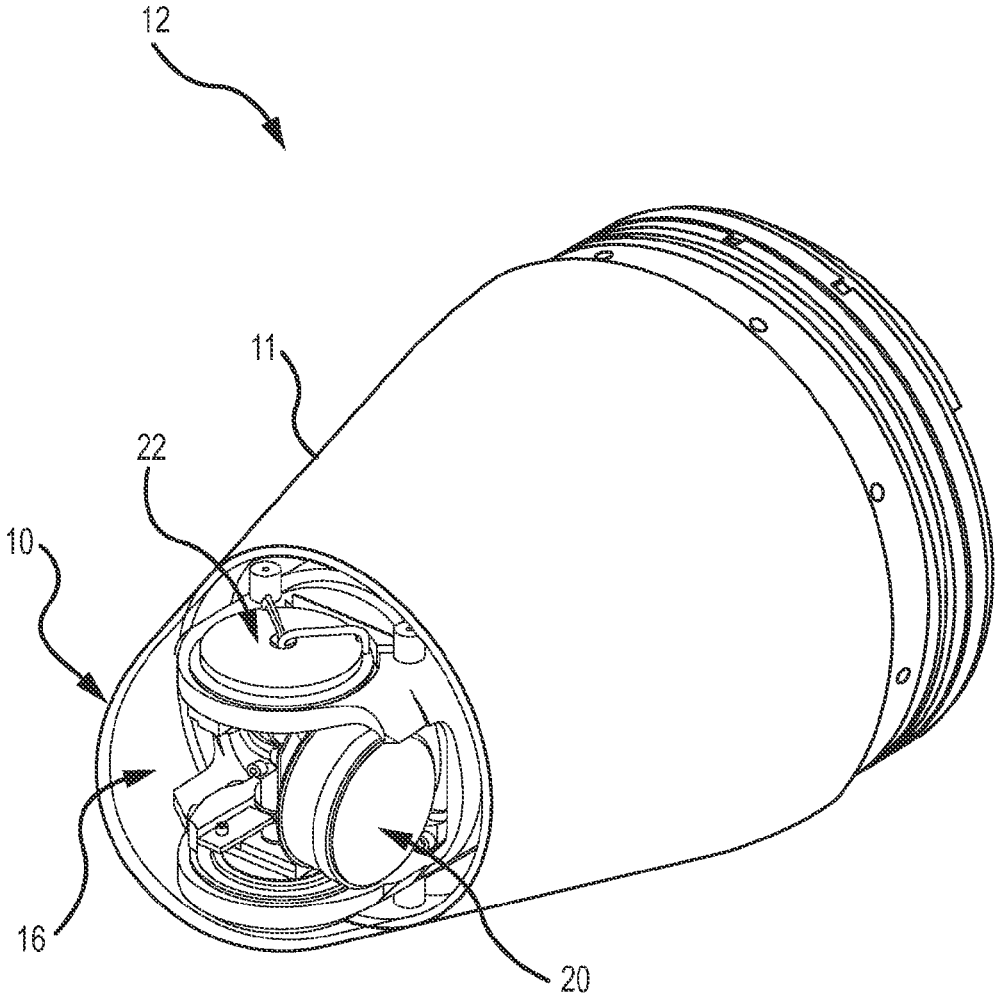
FIGS. 1*a* and 1*b* are an isometric and section view of the nose of a guided projectile incorporating a one-piece extended dome according to the invention.
Figure 1B:
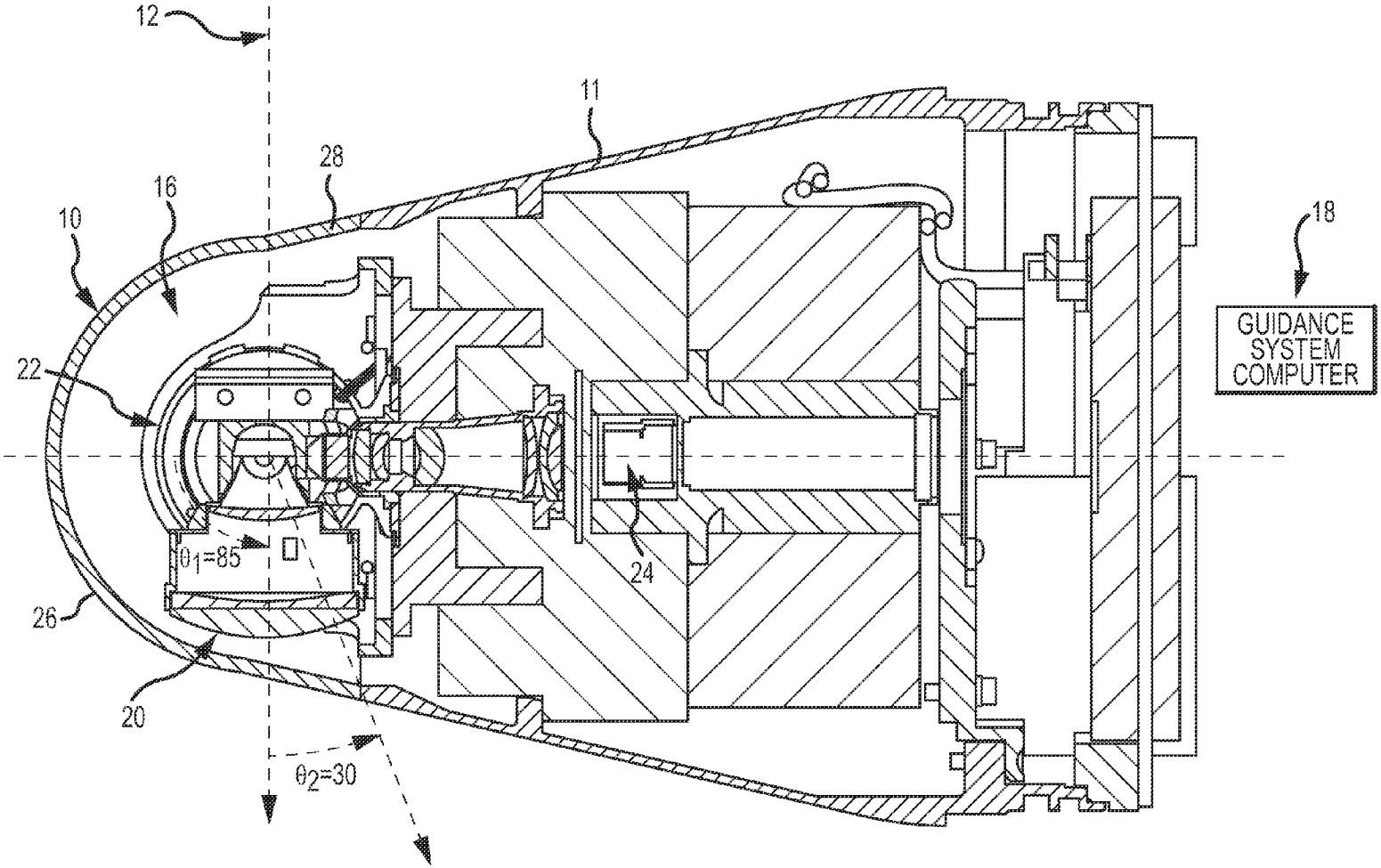

Referring now to FIGS. 1*a* and 1*b*, an embodiment of a one-piece extended dome 10 is mounted on the nose 11 of guided projectile 12. The nose is attached to a projectile body (not shown) that typically includes a fuze assembly and warhead and one or more aerodynamic control surfaces. Behind this dome, and within the nose 11 of the projectile, an EO seeker 16 is provided for capturing images, and conveying them to a guidance system computer 18, which in turn controls aerodynamic control surfaces (e.g. fins, canards, etc.) to guide the projectile to an object or point within the captured images. EO seeker 16 includes an objective lens 20 mounted on a gimbal mechanism 22 for movement in three degrees of freedom and a detector 24 receiving EMR passing through the objective lens to the detector which in turn conveys target information (e.g. bearing or images) to the guidance system. In an embodiment, the gimbal mechanism moves the object lens 20 in three degrees of freedom through a spanning angle greater than 180 degrees (look angle Θ greater than 90 degrees) without vignetting. In another embodiment, additional EO components are positioned behind and adjacent the extended portion of the dome to receive or transmit EMR through the extended portion of the dome. In this latter case, the gimbal mechanism may move the object lens through a spanning angle that may be less than or greater than 180 degrees depending on the configuration of the EO seeker.

One-piece Dome 12 is integrally-formed of a Nano/Nano class Nanocomposite Optical Ceramic (NNOC) material. The dome may be substantially transparent over a portion of the IR Band including near-IR (approximately 0.75-1.4 microns), short-wavelength IR (approximately 1.4 to 3 microns) and mid-wavelength IR (approximately 3 to 8.5 microns), long-wavelength IR (approximated 8 to 12 microns), or possibly the visible band (approximately 0.4 to 0.75 microns). In an embodiment using a mixture of yttria (yttrium oxide, $Y_2O_3$) and magnesia (magnesium oxide, MgO) the NNOC dome material transmits from 1.5 to 8.5 microns. The extended dome comprises seamless first and second non-complementary geometric shapes 26, 28, such as a first spherical geometry 26 and a second conical or ogive geometry 28. In this particular embodiment, the spherical geometry 26 supports a look angle $\Theta_1$ of 85° and the conical geometry 28 supports an additional look angle $\Theta_2$ of 30° for a total look angle Θ of 115°. The spherical geometry 26 is generally bounded to be less than 90°, typically 87° or less and is typically greater than 75°.

Figure 2:
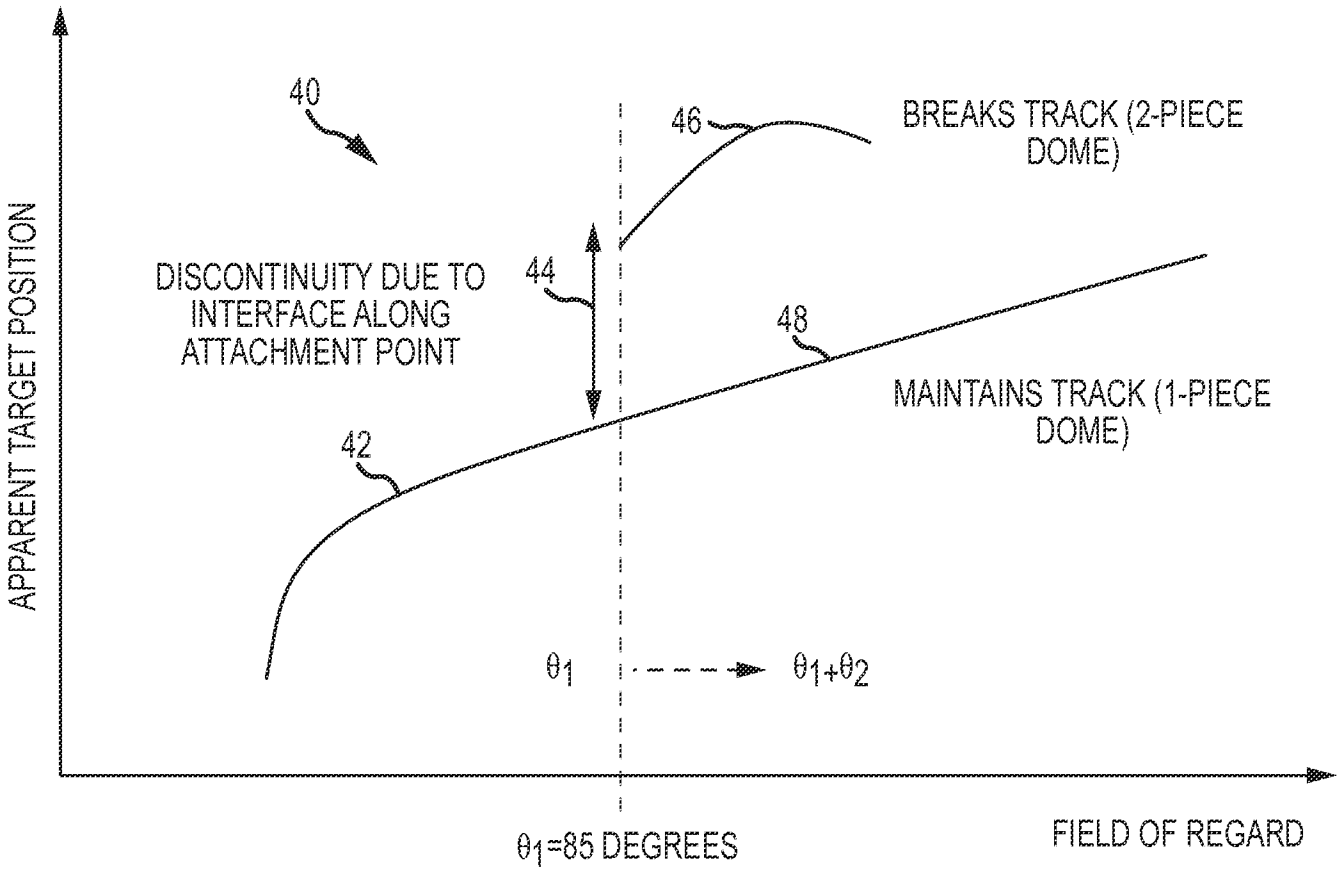
FIG. 2 shows the tracking of a target through a dome with and without an optical interface between the spherical and conical sections.

FIG. 2 plots apparent target position 40 versus look angle for a conventional two-piece extended dome and the one-piece extended dome of the present invention. In a typical EO seeker for either a guided projectile or DIRCM system, the seeker moves within the FOR to lock-on and track a target. As the seeker swings through the spherical section of the dome, for either the 2-piece or 1-piece configuration, the seeker maintains track 42 on the target. However, for two-piece domes as the seeker swings across the attachment point it sees a discontinuity due to the optical interface or blockage, which may produce a discontinuity 44 in apparent target position. The guidance system responds to this discontinuity, which may cause the projectile or DIRCM system to break track 46. This can result in mission failure. This risk is typically considered to be unacceptable, hence extended domes are generally not in use. But, as shown for the one-piece dome, as the seeker swings from the spherical geometry to the conical geometry it sees a seamless transition and maintains target track 48. This seamless transition between the non-complementary spherical and conical (or ogive) geometries enables the use of extended domes for guided projectiles and DIRCM.

Figure 3A:
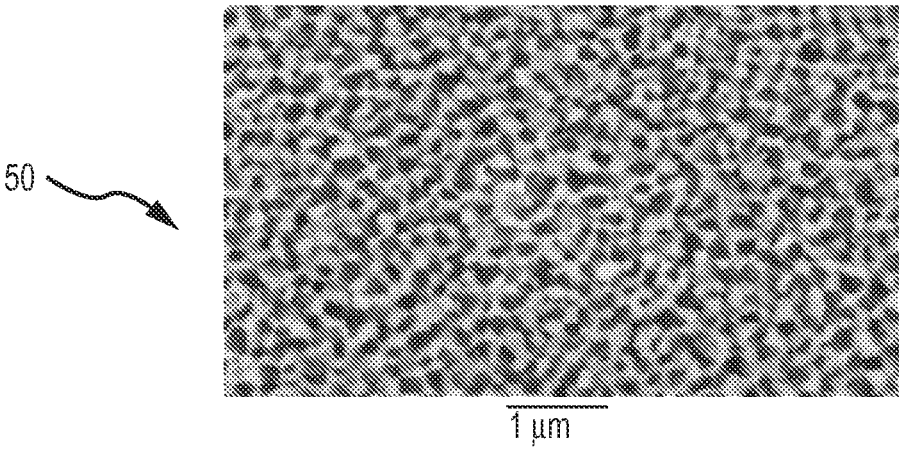
FIGS. 3*a*-3*b* show a Nano/Nano class NNOC material at different magnifications comprising two different nanograins.
Figure 3B:
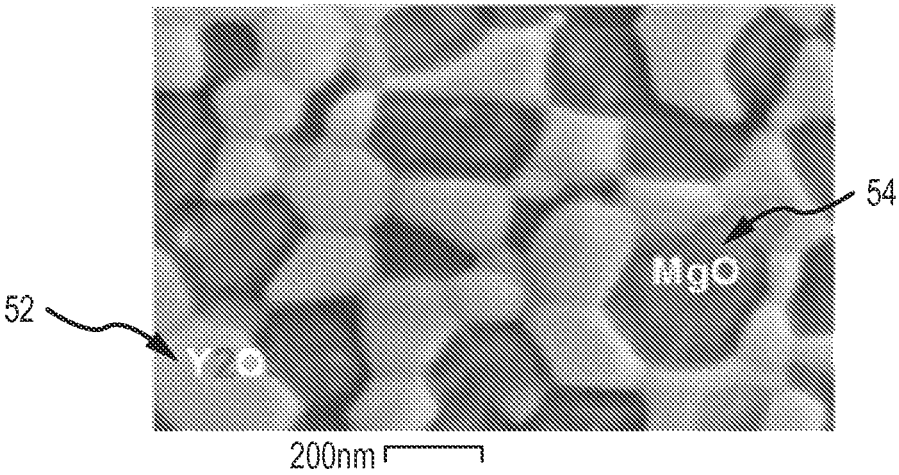

Referring now to FIGS. 3*a* and 3*b*, an embodiment of a Nano/Nano class NNOC powder material 50 comprises two or more different chemical phases (types of nanograins) dispersed in one another, each phase having a sub-micron grain dimension in at least the direction approximately perpendicular to the direction of propagation of the transmitted light. Furthermore, all of the nanograins have a sub-micron grain dimension in the direction approximately perpendicular to the direction of propagation of the transmitted light and preferably all directions that is less than approximately one-tenth and suitably one-twentieth of the wavelength of transmitted light. The different nanograins form material barriers to grain growth of the other thus strengthening the NNOC material. The mixture of the nanograins determines the dome's optical properties.

The powder material 50 is a true NNOC material in that all of the constituent elements have sub-micron grain dimensions; there is no host matrix. Extensive testing has revealed that the presence of a host matrix of larger grains limits the achievable strength of the material even if reinforced with nano-dispersoids. Such a material when formed into a one-piece extended dome does not possess adequate strength to bear the aerodynamic forces present during launch and flight of a guided projectile.

In this particular example, powder 50 comprises a mixture of yttria nanograins 52 and magnesia nanograins 54. The nanograins have a grain dimension that is sub-micron in all directions and less than approximately one-tenth the IR transmission wavelength. In some cases, the constraint of having a grain dimension less than approximately one-tenth the wavelength would not by itself necessitate a submicron size. Even so, the grain dimension requirement is for submicron size to be a nano/nano class NNOC material and to achieve the requisite strength.

In general, the two or more different types of nanograins in the powder are selected from materials, which are sufficiently transparent in the wavelength range of interest and can be processed to retain nanograins of submicron size in at least one direction. These materials include but are not limited to oxides, such as yttria, magnesia, alumina, (aluminum oxide ($Al_2O_3$), spinel (magnesium aluminum oxide ($MgAl_2O_4$) and non-oxides, such as carbides (e.g. silicon carbide (SiC)), oxycarbides (e.g. silicon oxycarbide ($SiO_xC_y$)), nitrides (e.g. silicon nitride ($Si_3N_4$)), oxynitrides (e.g. ($SiO_xN_y$)), borides (e.g. zirconium boride ($ZrB_2$)), oxyborides, (e.g. zirconium oxyboride ($ZO_xB_y$), sulfides, (e.g. zinc sulfide (ZnS)), selenides (e.g. zinc selenide (ZnSe)), sulfo-selenides (e.g. $ZnS_xSe_y$)), as well as semiconductors, such as silicon (Si) and germanium (Ge). The different types of nanograins in a given powder are mutually neutral in that they do not react chemically with each other. Furthermore, the nanograins are suitably selected so that they have similar refractive indices. The difference between refractive indices of nanograins in a given powder should be less than approximately 0.25. A large disparity in refractive indices will cause inter-particle scattering, which will degrade optical performance.

The mixture depicted in FIGS. 3*a* and 3*b* is 50/50 by volume. The relative percentages of the constituent nanograins in the powder (the composition of the powder) may be varied to achieve different optical properties, strength and thermal conduction. The relative percentages and types of nanograins maybe varied between the spherical and conical portions of the extended dome. The constituent elements and/or relative percentages are varied across the seamless transition between the two different geometries.

Figure 4:
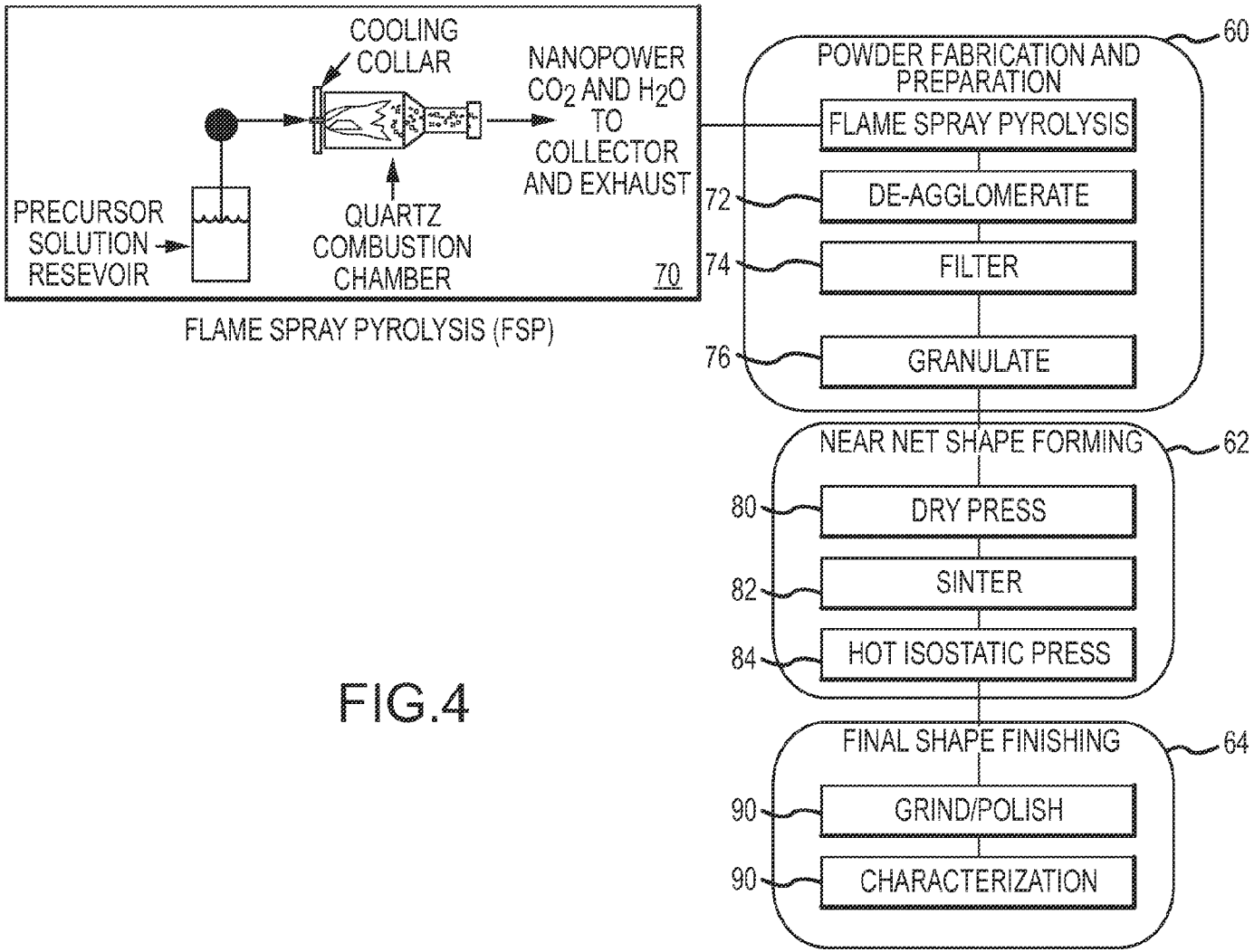
FIG. 4 is a flow diagram for manufacture of a one-piece extended dome from a NNOC.

Referring now to FIG. 4, an embodiment for integrally forming a one-piece extended dome from a Nano/Nano class NNOC powder comprises the steps of powder fabrication and preparation (step 60), near net shape forming (step 62) and final shape finishing (step 64). Fabrication and preparation may use a Flame Spray Pyrolysis (FSP) to provide a precursor solution of nano-sized Magnesium Oxide and Yttria Oxide (step 70). Other techniques may be employed to provide the precursor solution. The solution is de-agglomerated (step 72) e.g. ground and mixed with a mill, to break up any clumps. The solution is filtered (step 74) to remove impurities and any residual large particles from the solution. The solution is granulated (step 76) to remove the liquid solution to form a dry powder. Near net shape forming may be accomplished using a dry press process (step 80) in which the powder is packed into a mold of the desired extended dome and pressure is applied to produce a green body of the desired near net shape. A sintering process (step 82) applies heat to densify the green body. A hot isostatic press (step 84) applies heat and pressure to complete densification and eliminate any remaining voids to make a fully dense dome blank. Final shape finishing includes precision grinding and polishing (step 90) the surface of the dome to the finished shape and characterization (step 92) of the dome's mechanical and optical properties to verify the dome meets the specifications.

Figure 5:
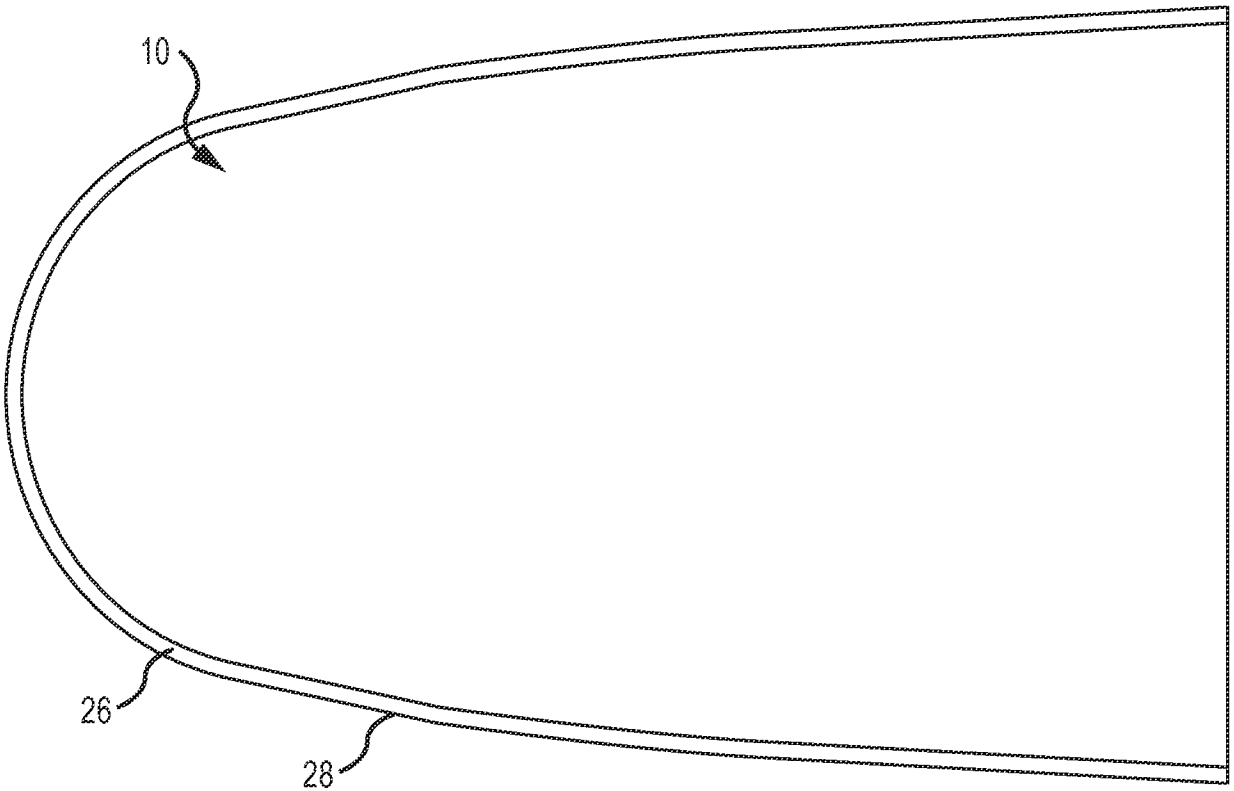
FIG. 5 is a section view of a one-piece extended dome comprising a seamless transition between the non-complementary spherical and conical geometries.

Referring now to FIG. 5, the transition from the spherical shape 26 to the conical shape 28 of the extended dome 10 is seamless, no attachment points or optical interfaces.

The one-piece extended dome comprises seamless first and second non-complementary geometric shapes. Non-complementary means they are sections of different geometries e.g. spherical and conical or spherical and ogive. Other non-complementary pairings may also be possible. The typical shape will include a spherical leading shape and either a conical or ogive trailing shape to flare the dome to meet the diameter of the platform.

Figure 6A:
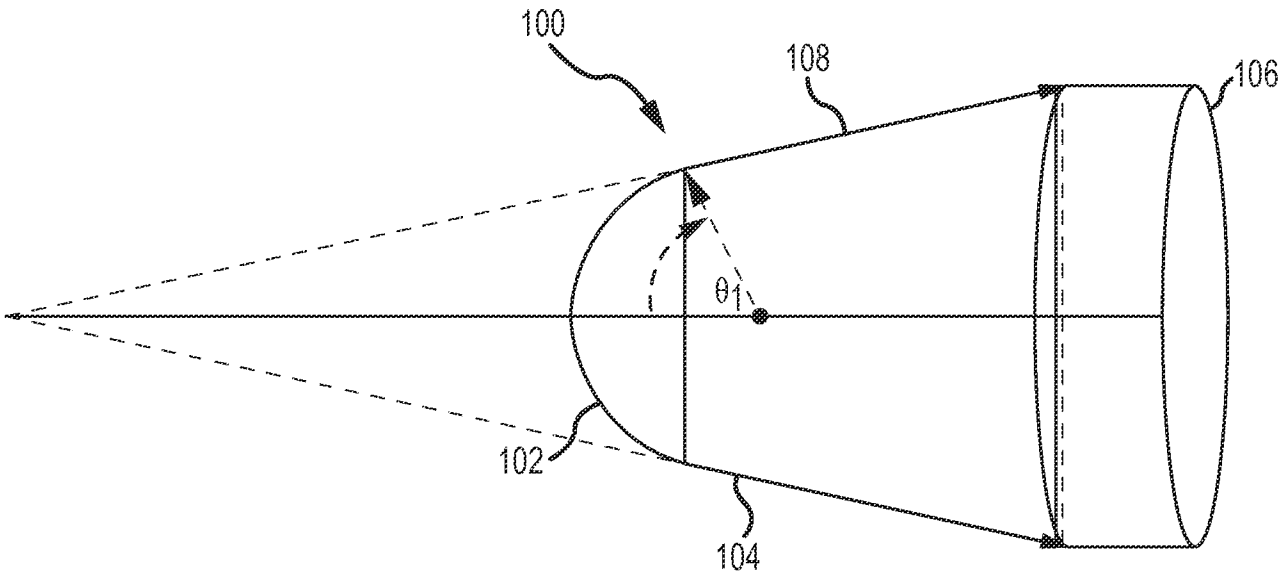
FIGS. 6*a* through 6*c* are section views of different sphero-conical geometries.
Figure 6B:
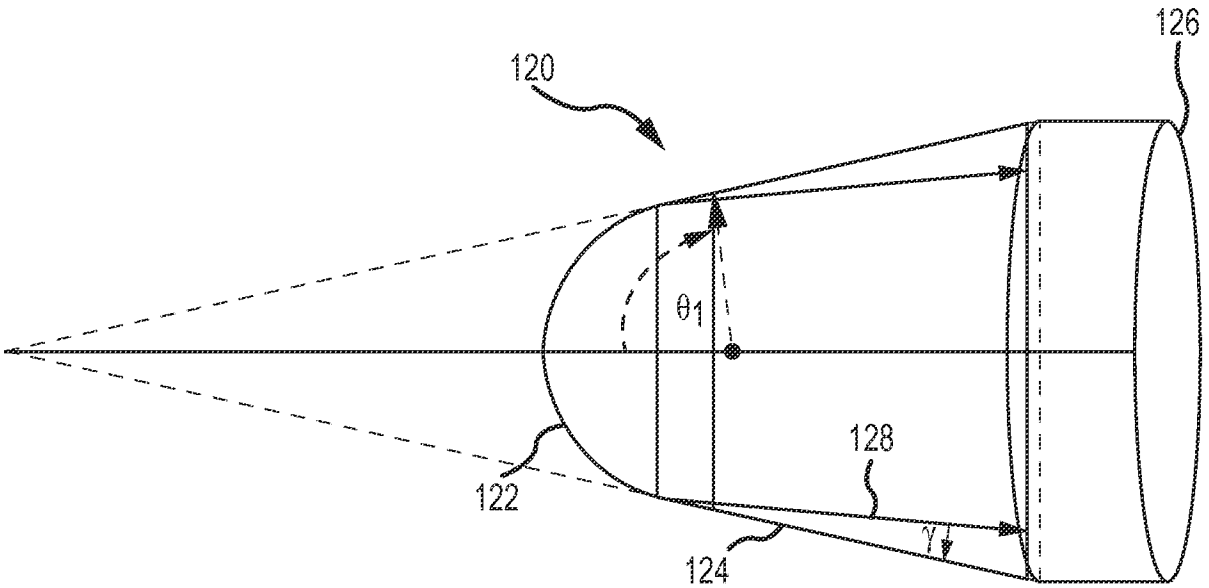
Figure 6C:
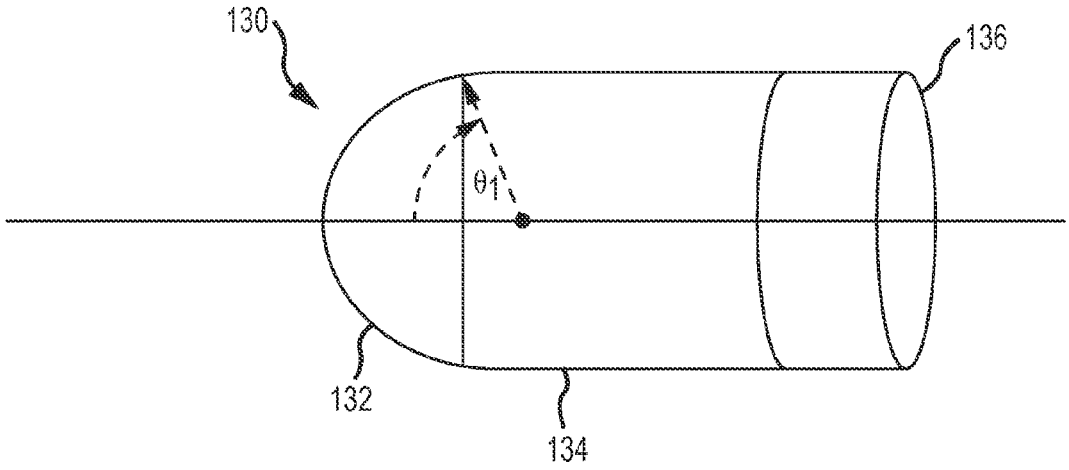

FIGS. 6*a* through 6*c* illustrate different embodiments of a sphero-conical dome. Referring now to FIG. 6*a*, a one-piece extended dome 100 integrally formed of a Nano/Nano class NNOC material comprises a leading spherical shape 102 and a trailing conical shape 104 that flares the diameter of the dome from the diameter of the spherical shape to the diameter of the platform 106. The conical geometric shape has inner and outer surfaces tangent to inner and outer surfaces respectively of the spherical shape at the point of seamless transition. In other words, lines 108 tangent to the surfaces of the spherical shape at the transition are coincident with the conical shape. In this case, the look angle $\Theta_1$ of spherical shape 102 is selected to satisfy this constraint. That angle will depend upon the platform diameter and any overall length limitation on the dome itself. This approach ensures a smooth physical transition between the spherical and conical shapes but may not maximize the look angle of the spherical shape, which is generally desirable.

Referring now to FIG. 6*b*, a one-piece extended dome 120 integrally formed of a Nano/Nano class NNOC material comprises a leading spherical shape 122 and a trailing conical shape 124 that flares the diameter of the dome from the diameter of the spherical shape to the diameter of the platform 126. The conical shape has inner and outer surfaces that form a non-zero positive angle $\gamma$ to surfaces 128 tangent to inner and outer surfaces respectively of the spherical shape at the point of seamless transition. In other words, the conical shape forms a skirt that flares outwards at a larger angle to transition from the diameter of the spherical shape to the platform diameter. In this case, the look angle $\Theta_1$ of spherical shape 122 is suitably selected to be as close to 90° as practicable. This maximizes the look angle of the spherical shape.

Referring now to FIG. 6*c*, a one-piece extended dome 130 integrally formed of a Nano/Nano class NNOC material comprises a leading spherical shape 132 and a trailing conical shape 134 that extends the dome to platform 136. This is a special case in which the diameter of the spherical section equals the diameter of the platform. In this special case the apex of the conical shape is at infinity whereby the conical shape becomes a cylinder. The surfaces of the cone lie at a non-zero negative angle with respect to the tangent surfaces of the spherical shape unless the spherical shape is 90 degrees in which case they are tangent.

Figure 7:
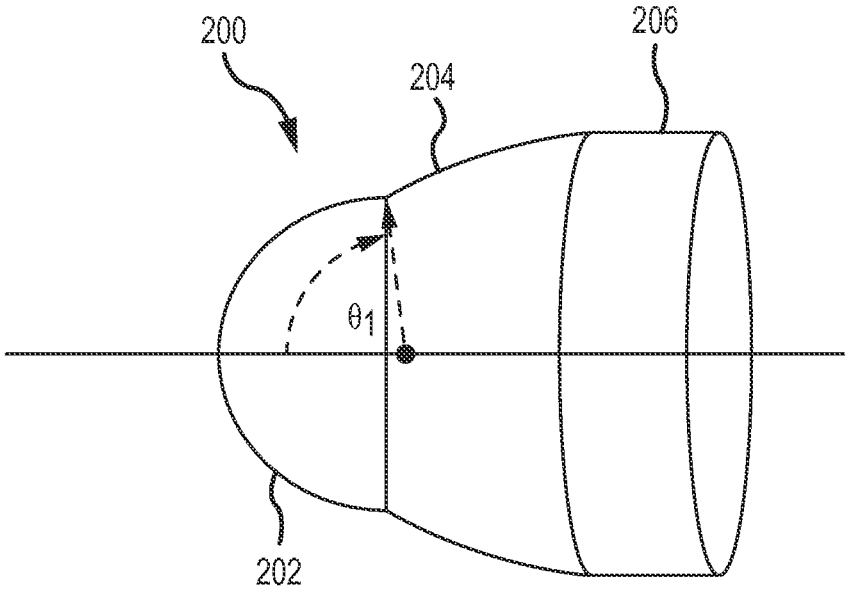
FIG. 7 is a section view of a sphero-ogive geometry.

Referring now to FIG. 7, a one-piece extended dome 200 integrally formed of a Nano/Nano class NNOC material comprises a leading spherical shape 202 and a trailing ogive shape 204 that flares the diameter of the dome from the diameter of the spherical shape to the diameter of the platform 206. An ogive is a section or a large radius or arc. In the extremes as the radius gets larger the arc flattens approaching a cone and as the radius gets smaller the arc gets more pronounced approaching a hemisphere.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A one-piece transparent extended dome having a spanning angle greater than 180 degrees, said extended dome comprising seamless first and second non-complementary geometric shapes that are sections of different geometries integrally formed as a unitary object of a Nano/Nano class Nanocomposite Optical Ceramic (NNOC) material, said Nano/Nano class NNOC material comprising two or more different types of nanograins dispersed in one another, each type of nanograin having a grain size that is sub-micron in all dimensions of the grain.

2. The one-piece transparent extended dome of claim 1, wherein the first geometric shape comprises a section of a sphere having a spanning angle less than 180 degrees.

3. The one-piece transparent extended dome of claim 2, wherein the second geometric shape comprises a section of it cone.

4. The one-piece transparent extended dome of claim 3, wherein said second conical geometric shape has inner and outer surfaces tangent to inner and outer surfaces respectively of the first spherical shape at the point of seamless transition.

5. The one-piece transparent extended dome of claim 3, wherein said second conical geometric shape has inner and outer surfaces that form a non-zero positive angle to surfaces tangent to inner and outer surfaces respectively of the first spherical shape at the point of seamless transition.

6. The one-piece transparent extended dome of claim 2, wherein the second geometric shape comprises a section of an ogive.

7. The one-piece transparent extended dome of claim 1, wherein the NNOC material comprises no host matrix material, all constituent elements of the material are nanograins in which the grain size in all dimensions is less than approximately one-tenth the wavelength of transmitted light and less than one micron.

8. The one-piece transparent extended dome of claim 7, wherein the two or more different types of nanograins are selected from Yttria Oxide (Y203), Magnesia Oxide (MgO.), Aluminum Oxide (AL203), magnesium aluminum oxide ($MgAl_2O_4$), carbides, oxycarbides, nitrides, oxynitrides, borides, oxyborides, sulfides, selenides, sulfo-selenides and semiconductors.

9. The one-piece transparent extended dome of claim 8, wherein the two or more different types of nanograins have indices of retraction that differ by no more than 0.25.

10. The one-piece transparent extended dome of claim 1, wherein the wavelength of transmitted light through the NNOC material spans 3-5 microns.

11. A one-piece transparent extended dome for mounting on an airborne platform, said extended dome comprising a seamless transition from a first spherical to a second conical or ogive geometric shape providing a spanning angle greater than 180 degrees, said dome integrally firmed of a Nano/Nano class Nanocomposite Optical Ceramic (NNOC) material, said Nano/Nano class NNOC material comprising two or more different types of nanograins dispersed in one another and no host matrix material, each type of nanograin having a grain size that is sub-micron in all dimensions of the grain, said types having indices of refraction that differ by no more than 0.25.

12. An apparatus, comprising:

an airborne platform;

an electro-optic sensor system on the airborne platform, said system including an objective lens mounted on a gimbal mechanism for movement in three degrees of freedom and a detector receiving radiant energy passing through the objective lens; and a one-piece transparent extended dome on said platform over the electro-optic sensor system, said extended dome providing a spanning angle greater than 180 degrees, said extended dome comprising seamless first and second non-complementary geometric shapes that are sections of different geometries integrally formed as a unitary object of a Nano/Nano class Nanocomposite Optical Ceramic (NNOC) material, said Nano/Nano class NNOC material comprising two or more different types of nanograins dispersed in one another, each type of nanograin having a grain size that is sub-micron in all dimensions of the grain.

13. The apparatus of claim 12, wherein the gimbal mechanism moves the object lens in three degrees of freedom through a spanning angle greater than 180 degrees.

14. The apparatus of claim 12, wherein the airborne platform comprises a guided projectile.

15. A method of producing a transparent extending dome having a spanning angle larger than 180 degrees, comprising:

providing a Nano/Nano class Nanocomposite Optical Ceramic (NNOC) powder including two or more different types of nanograins dispersed in one another, each type of nanograin having a grain size that is sub-micron in all dimensions of the grain;

forming the powder into a one-piece extended dome comprising seamless first and second non-complementary geometric shapes that are sections of different geometries; and finishing the one-piece extended dome.

16. The method of claim 15, wherein the powder is provided using flame spray pyrolysis.

17. The method of claim 15, wherein the nanocomposite does not include a host matrix.

18. The method of claim 15, wherein the powder is formed into the one-piece extended dome by packing the power into a preshaped mold and pressing the powder into a near net shape green body;

applying heat to densify the green body; and applying heat and pressure to make a fully dense dome.

19. The method of claim 18, wherein the preshaped mold comprises a section of a sphere having a spanning angle less than 180 degrees and a section of a cone that extends the spanning angle beyond 180 degrees, wherein said conical section has inner and outer surfaces that form a non-zero positive angle to surfaces tangent to inner and outer surfaces respectively of the spherical section at the point of seamless transition.

* * * * *